US012059717B2

(12) United States Patent
Toschi

(10) Patent No.: US 12,059,717 B2
(45) Date of Patent: Aug. 13, 2024

(54) ROLLING PROCESS FOR SOLID-SECTION PRODUCTS AND A ROLLING MILL

(71) Applicant: Pomini Long Rolling Mills S.r.l., Legnano (IT)

(72) Inventor: Francesco Toschi, Legnano (IT)

( * ) Notice: Subject to any disclaimer, the term of this patent is extended or adjusted under 35 U.S.C. 154(b) by 235 days.

(21) Appl. No.: 17/756,313

(22) PCT Filed: Nov. 25, 2020

(86) PCT No.: PCT/IB2020/061144

§ 371 (c)(1),
(2) Date: May 22, 2022

(87) PCT Pub. No.: WO2021/105896

PCT Pub. Date: Jun. 3, 2021

(65) Prior Publication Data

US 2023/0347397 A1 Nov. 2, 2023

(30) Foreign Application Priority Data

Nov. 29, 2019 (IT) ..... 102019000022521

(51) Int. Cl.

| | |
|---|---|
| ***B21B 13/02*** | (2006.01) |
| ***B21B 13/00*** | (2006.01) |
| ***B21B 31/20*** | (2006.01) |
| ***B21B 45/00*** | (2006.01) |

(52) U.S. Cl.

CPC ..... *B21B 13/02* (2013.01); *B21B 31/20* (2013.01); *B21B 45/004* (2013.01); *B21B 2013/006* (2013.01)

(58) Field of Classification Search

CPC ..... B21B 37/56; B21B 37/58; B21B 37/48; B21B 37/70; B21B 2013/006; B21B 45/004; B21B 13/02; B21B 31/20

See application file for complete search history.

(56) References Cited

FOREIGN PATENT DOCUMENTS

| | | | |
|---|---|---|---|
| CN | 106077085 | | 11/2016 |
| CN | 106077085 A | * | 11/2016 |
| EP | 0659493 | | 6/1995 |
| JP | S61212404 | | 9/1986 |

(Continued)

OTHER PUBLICATIONS

Translation of CN-106077085-A (Year: 2016).*
Translation of JP-S61212404-A (Year: 1986).*

*Primary Examiner* — Bobby Yeonjin Kim
(74) *Attorney, Agent, or Firm* — Themis Law

(57) ABSTRACT

A rolling process for long solid-section products includes the steps of rolling stock through a plurality of rolling mill stands, the rolled stock being subjected to a tensile load, between the plurality of stands, that generates a single-axial deformation greater than 0.1 in the rolling direction, and is also deformed by compression between the rolls of at least one of the rolling mill stands, thereby achieving a reduction in the cross section area of at least 5%, preferably of between 5 and 50%. A rolling mill, in which a plurality of stands is connected by spacer elements designed to offset the tensile load; a rolling mill, in which a plurality of stands is connected by elements designed to offset the overturning moment generated by the tensile load; and a rolling mill, in which the aforesaid rolling stands maintain a non-slip condition.

6 Claims, 3 Drawing Sheets

(56) References Cited

FOREIGN PATENT DOCUMENTS

| | | | |
|---|---|---|---|
| JP | S61212404 A | * | 9/1986 |
| JP | H0760301 | | 3/1995 |
| KR | 100523099 | | 10/2005 |

* cited by examiner

ROLLING PROCESS FOR SOLID-SECTION PRODUCTS AND A ROLLING MILL

The present invention relates to a rolling process for long products, in particular for solid-section products such as bars, rolls of rod, wire rods, billets, and the like. The invention also relates to a rolling mill, comprising two or more rolling stands for carrying out the said process.

The processes for rolling manufactured articles of the kind considered are usually carried out in rolling mill trains comprising a plurality of stands. The stands feature a pair of cylinders or multiple cylinders shaped, if necessary, so as to be suitable to achieve the desired geometric form, the product passing through the said cylinders under suitable pressure. The compression force, which is obtained by adjusting the distance between the mill rolls in a predefined way, is applied to the rolled stock, which is therefore compressed and the section thereof reduced. Apart from the section being reduced, the geometric form is also modified. The processing temperature is kept at appropriate levels and, if necessary, heaters (generally induction heaters) may be featured between the stands of one or more successive pairs. In the case of carbon steels, the mills usually operate at temperatures which ensure the material has an austenitic structure.

Each stand, therefore, generates a reduction in the section and consequent elongation of the rolled stock, and the succession of stands (in many rolling trains, the number of stands can be well above ten) brings the product from the starting section to the desired end section. Very often, the process also involves changing the shape of the section of the rolled stock, both by adjusting the pressure applied at the various stands, whose cylinders may have different positioning (for example, stands with horizontal-axis cylinders are generally alternated with vertical-axis cylinder stands, or there are also four-cylinder stands) and by using grooves with different geometric forms in the said cylinders. The rotation speed of the rolling cylinders can be adjusted extremely precisely, as the stands generally feature electric machines equipped with inverters which regulate the power frequency of the cylinder drive motors. The rotation speed of the cylinders in each stand is adjusted appropriately based on the section of the product in the specific stand and ensures the product is driven through the mill as a result of the friction applied thereto by the cylinders. The speed is adjusted in such a way as to prevent the generation of significant tensile or compression stresses in the product between two successive stands, to prevent uncontrolled repercussions on the shape and section of the product, possible slippage of the product between the cylinders in the stand downstream of the pair concerned, and superficial damage to the product. The reduction in section achieved at each stand is limited by the risk of generating compression stresses between the cylinders, which are nevertheless considerable. Based on the foregoing, it follows that rolling processes require numerous stands (or, according to other types of process, a high number of runs through one or more stands), with considerable expenditure in time and power (including any power used to keep the material warm between one run and the next, keeping it at temperatures which are suitable for the process, and offsetting the heat loss that occurs during the long series of runs undergone within systems which are considerable in size with respect to their productivity).

On the other hand, in the case of products such as those stated above, compression rolling is almost always the only process that guarantees acceptable levels of productivity when reduction in section is required. Other types of process for reducing the gauge of long products are only applied for products that cannot be processed by compression methods. For example, reducing the gauge of pipes can be achieved by applying a light tensile force.

It would therefore be advisable to be able to increase the productivity of the rolling stands in order to reduce the steps needed to achieve the desired reduction in the overall section of the rolled stock with the considerable economic advantages stated above. These objectives have now been achieved according to the present invention by means of a rolling process for long solid-section products, comprising rolling through at least one pair of rolling mill stands, wherein rolled stock is subjected to a tensile load, between the two stands, which generates a single-axis deformation, or strain s, greater than 0.1 in the rolling direction, and is deformed by compression between the rolls of at least one rolling mill stand in the said pair, thereby achieving a reduction in the area of the cross section of at least 5%.

As it is known, the said strain c is defined using the following formula:

$$\ln\left(1+\frac{\Delta L}{L_0}\right)=\ln\left(\frac{A_0}{A}\right)$$

Where $L_0$ and $A_0$ are, respectively, the initial length of the rolled stock, the initial cross-sectional area (in the direction in which the tensile load is applied) of the rolled stock, $\Delta L$ is the absolute elongation of the rolled stock, and A is the final area of the cross-section of the rolled stock.

The process also includes the deformation of the rolled stock through compression between the cylinders in at least one stand, achieving in the said stand a reduction in the cross-sectional area of at least 5%, preferably of between 5 and 50%, similarly to what occurs in rolling stands according to the commonly known technique.

According to one possible aspect of the invention, the process involves determining a maximum permissible single-axial deformation in the operating conditions between the two stands and a tensile load which generates a lower single-axial deformation than the said maximum permissible single-axial deformation.

According to a further preferred aspect, the rolled stock temperature is kept at between 850 and 1200° C.

The solid-section products may have any shaped cross section. The process is particularly suitable for convex shapes or shapes that can be achieved by rolling involving tri-axial deformation (by compression), such as, for example, round, elliptical, rectangular, square, hexagonal sections . . . .

The invention also includes a rolling mill train comprising at least two stands, in which the two stands are connected by spacer elements so as to offset the tensile load applied to the rolled stock and so as to keep the stands mutually stationary or prevent the said load from being applied to elements anchoring the stands to external structures.

The invention will now be better described through the provision of preferred exemplifying embodiments, with particular reference to the figures, in which:

FIG. 1 provides an example of maps that correlate an incipient necking and the process parameters, which are useful to optimise the working conditions in a process according to the present invention;

Contrary to the processes according to the commonly known technique, to operate according to the present invention it is necessary to apply a tensile force force between two successive stands in a rolling mill. The application of force leads to a reduction in the cross-sectional area of the workpiece and the deformation defined above. As mentioned, deformation between at least two stands is at least 0.1, although it is preferably higher and preferably reaches the maximum admissible conditions, under which it is possible to operate without incurring material breakage. According to one possible aspect, operation is kept below incipient necking conditions (necking being a decreased cross-sectional area in a single section of the material under tension). The greater the elongation, the more advantageous the process will be, and fewer runs will be required in order to achieve the decreased overall section, potentially reducing the number of stands in the rolling mill, or increasing productivity.

It is therefore important to establish, on the basis of the operating conditions, a condition of maximum admissible deformation combined with a maximum admissible tensile force, or tension, to be applied to the section between two successive rolling stands. As is known, the operating conditions may vary greatly from one pair of stands to the others within the same rolling mill. In order to establish the condition stated above, any methodology may be applied which is suitable for modelling the behaviour of the material in working conditions.

One example of a possible way of calculating the operating conditions is based on the Hollomon Zener parameter (Z), as stated below:

$$Z = \acute{\varepsilon} \exp\left(\frac{Q}{RT}\right)$$

Where $\acute{\varepsilon}$[s−1] is the strain rate (parameter defined by the process, correlated with the difference in roll speed in the successive stands), Q is the activation energy (in the case of industrial steels it can be considered as amounting to 277619.2884 J/mol), R is the gas constant, and T the process temperature.

From this parameter one can obtain the maximum stresses and strains (breaking point) and the stresses and strains of incipient necking, which are respectively:

$$\sigma = \text{arcsenh}(0.00241Z^{0.250}$$

$$\varepsilon = 0.385P_{AGS}^{0.3}Z^{0.03365}$$

$$\sigma_{necking} = 100 \text{ arcsenh}(0.00354Z^{0.233})$$

$$\varepsilon_{necking} = 0.0084(P_{AGS}^{0.3}\ln(Z))^{0.750}$$

Where $P_{AGS}$ [μm] is the grain size in working temperature (austenitic) conditions (prior austenitic grain size) and the stresses are in MPa.

Figure 1:
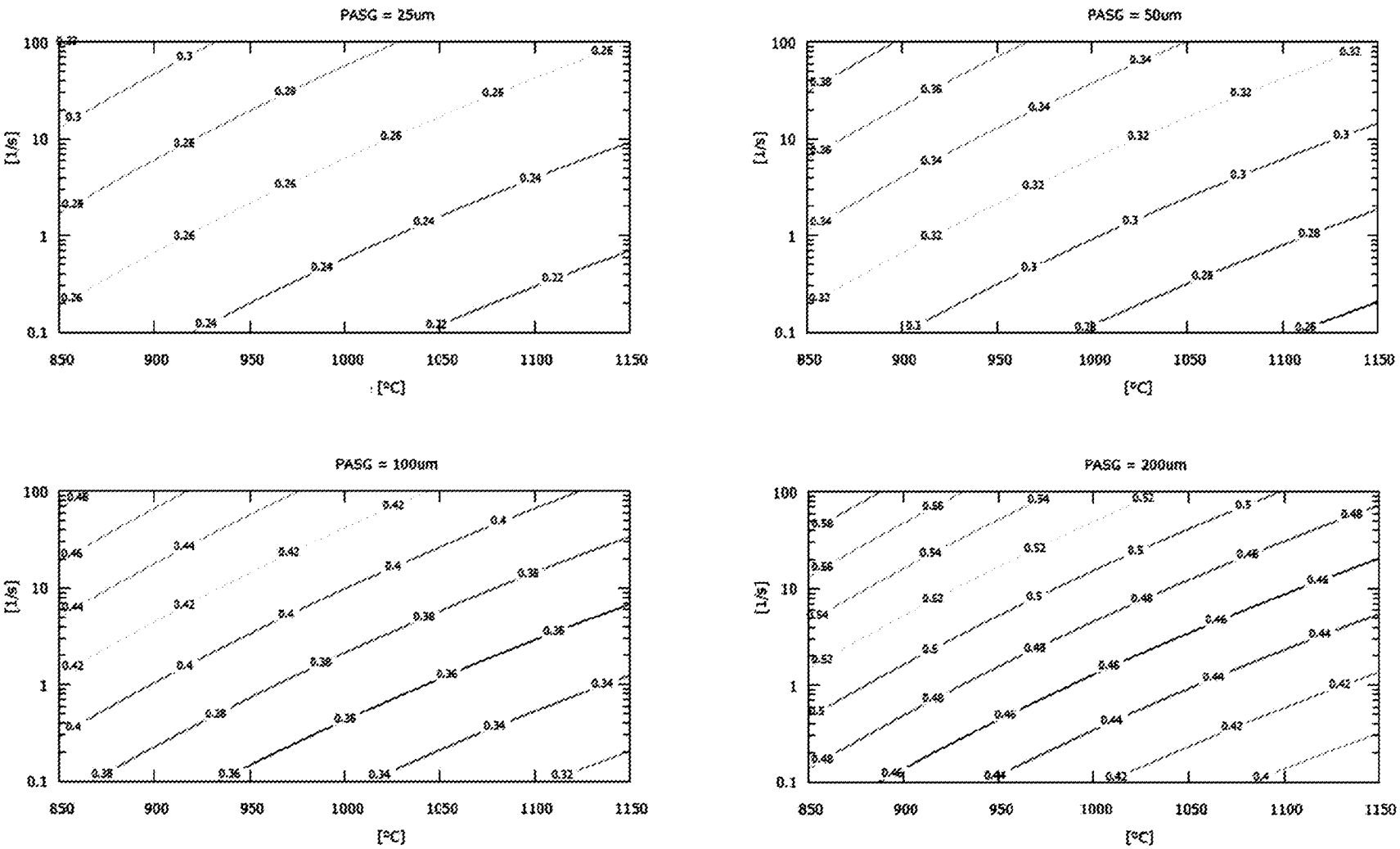

Tests were performed on (unalloyed) industrial rolling steels at temperatures of 850, 950, 1050° C. (standard operating temperatures for rolling mill stands) for strain rates of 1 and 5 s−1 and for $P_{AGS}$ of 33 and 100 μm (standard conditions that occur during, respectively, an intermediate processing stage and roughing) and grip was found with a margin of error within 10%, which makes the formulas usable to determine the process conditions in a process according to the present invention. FIG. 1 shows, for different $P_{AGS}$, maps that correlate the maximum strain with the strain rate and temperature.

Under certain conditions, however, there may be problems relating to surface damage which could pose a further limit that must be taken into account when determining the operating parameters.

For this purpose, it is possible to use formulas available in the literature, such as that Lemaitre's formula or a modified version of Lemaitre's formula. It has been seen that, in the case of rolling steels, there are often no surface damage problems when the strains are applied as stated above. Particular attention may be required in particular cases, for example steels with a significant copper or tin content. In this case, the strain limits may be lowered appropriately. Data for the formulas used are available in the literature or can be easily found through testing and processing by a person skilled in the art. According to a preferred aspect of the invention, the process also involves adjusting the distance (gap) between the rolls on at least one stand (in particular the one downstream) during rolling, in particular during start-up. This is because, as the section gradually decreases through the application of tensile force, less friction will be exerted between the rollers on the stand downstream. In the event of loss of grip, there may be a return to a condition of no tensile force and therefore an increase in the section. If anything, there may be alternating sections with a reduced section and sections with a larger section where tensile force ceases. Therefore, continuous adjustment of the roll distance is preferable, in order to work with as constant a tensile force as possible, which can be achieved through a gradual increase in tensile force during start-up. Alternatively, an acceptable situation is that described above, in particular that described for the upstream stands in a rolling mill with several stands. The distance between the rolls can be checked using the current absorbed by the electric motors driving the rollers.

The invention also concerns a rolling mill in which at least two stands are connected by elements designed to offset the overturning moment generated by the tensile load.

A rolling mill in which the aforesaid rolling stands maintain a non-slip condition.

Figure 2:
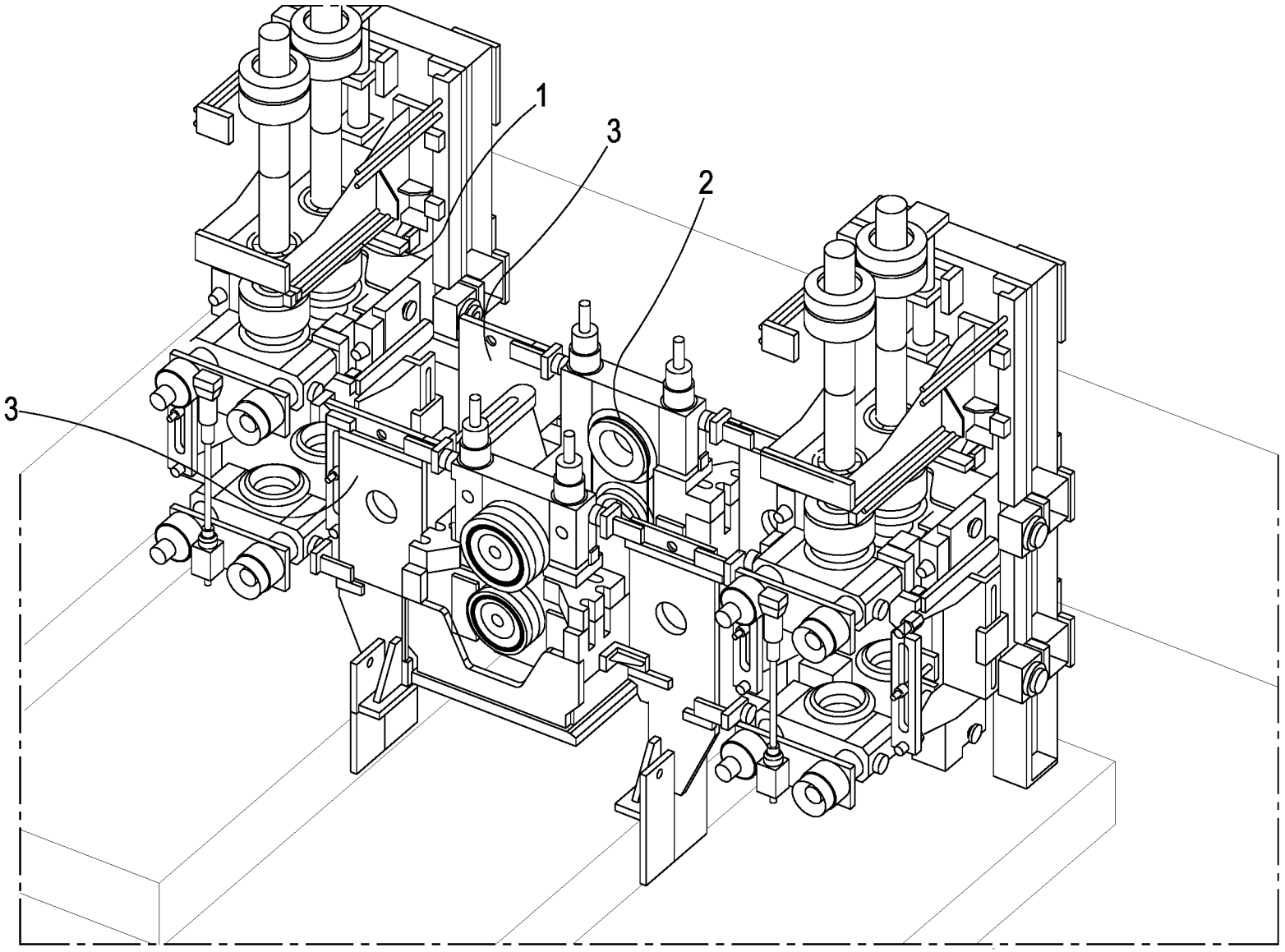
FIG. 2 is a schematic representation of a perspective view of successive stands in a rolling mill train according to the present invention.
Figure 3:
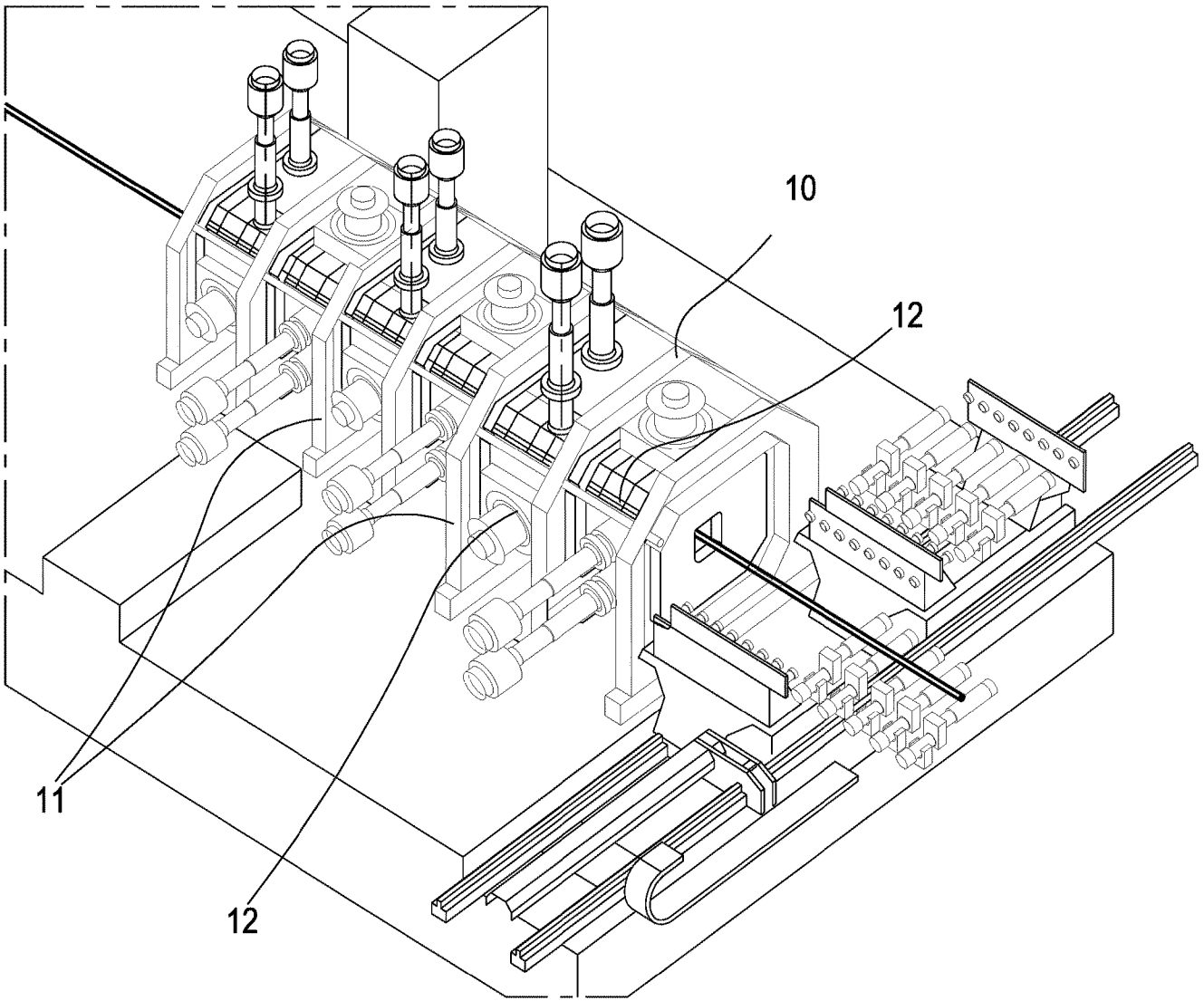
FIG. 3 is a schematic representation from a perspective view of a rolling mill train according to a different aspect of the present invention.

FIG. 2 shows, schematically, a detail of a rolling mill according to the present invention. The rolling mill comprises at least two successive stands 1 and 2. Between the successive stands, as illustrated above, tensile force is applied to the rolled stock. The stresses involved are considerable, therefore, with stands anchored to the ground or to the walls of a building, as is usually the case, considerable flexural stresses could be generated. In order to prevent this occurring, according to the present invention spacer elements 3 are envisaged so as to offset the tensile force between the stands, thereby preventing stresses on the anchors. According to a preferred aspect, the spacers are arranged so as to prevent flexural stresses, for example, essentially symmetrically (in front and behind) with respect to the stands. In this way, if desired, it would also be possible to eliminate the anchors to the ground or to external structures in at least part of the stands, since the stands are connected to each other and their mutual position is maintained by the spacer elements. FIG. 3 shows a possible alternative. In this case a structure 10 with dividers 11 contains the stands 12 and keeps them in a mutually fixed position.

The invention claimed is:

1. A rolling process for long solid-section products, comprising:

rolling a stock through a plurality of rolling mill stands, wherein the rolled stock is subjected to a tensile load, between the plurality of stands, which generates a single-axial deformation ε greater than 0.1 in a rolling direction, and is further deformed by compression between rolls of at least one of the plurality of rolling mill stands, thereby achieving a reduction in a cross section area of at least 5%.

2. The process according to claim 1, wherein the rolled stock is deformed by compression between the rolls of at least one of the plurality of rolling mill stands, thereby achieving a reduction in the cross section area of between 5 and 50%.

3. The process according to claim 1, wherein the rolled stock is kept at a temperature ranging from 850 to 1200° C.

4. The process according to claim 1, wherein a distance between rolls in at least one of the plurality of rolling mill stands is adjusted according to a variation in a cross section of the rolled stock feeding into the at least one of the plurality of rolling mill stands.

5. The process according to claim 1, wherein an end article according to the process is a solid-section bar with a rounded, square, hexagonal, or rectangular shape with or without fillet radii.

6. The process according to claim 4, wherein the variation is a variation in current absorbed by the at least one of the plurality of rolling mill stands.

* * * * *